United States Patent [19]

Stark

[11] 3,963,301

[45] June 15, 1976

[54] MOTHER-BOARD INTERCONNECTION SYSTEM

[75] Inventor: William H. Stark, West St. Paul, Minn.

[73] Assignee: Sperry Rand Corporation, New York, N.Y.

[22] Filed: Dec. 20, 1974

[21] Appl. No.: 535,074

[52] U.S. Cl. ..... 339/186 M; 339/66 M

[51] Int. Cl.[2] ..... H01R 13/64

[58] Field of Search ..... 339/65, 66 R, 66 M, 339/184 R, 184 M, 186 R, 186 M, 186 T

[56] References Cited

UNITED STATES PATENTS

| | | | |
|---|---|---|---|
| 3,166,372 | 1/1965 | Just | 339/186 M |
| 3,177,462 | 4/1965 | Sarnmark | 339/186 M |
| 3,611,272 | 10/1971 | Fairbairn | 339/184 M |
| 3,651,444 | 3/1972 | Desso | 339/184 M |
| 3,740,697 | 6/1973 | Van Son | 339/186 M |

FOREIGN PATENTS OR APPLICATIONS

| | | | |
|---|---|---|---|
| 2,021,547 | 11/1971 | Germany | 339/186 M |

*Primary Examiner*—Roy Lake
*Assistant Examiner*—Mark S. Bicks
*Attorney, Agent, or Firm*—Kenneth T. Grace; Thomas J. Nikolai; Marshall M. Truex

[57] ABSTRACT

An electronic packaging system for a digital data processing system is disclosed. The packaging system includes a multi-layer printed circuit mother-board having a plurality of double-ended pass-through electrical male contacts arranged in a plurality of similar patterns. The patterns of male contacts conform to and mate in electrical contact with the pattern of electrical female contacts of an electrical connector assembly. The electrical connector assembly is comprised of an insulative connector body having a mating surface and, parallel thereto, stepped, different-dimensioned, first, second and third bottom edges. Three parallel rows of parallel apertures pass through the connector body from the mating surface to the first, second and third bottom edges for forming three rows of stepped, different-dimensioned length apertures. Electrical female contacts of substantially similar design are loosely held in each of the apertures with their tail portions projecting beyond the associated one of said first, second or third bottom edges. The tail portions are then bent 90° to form a pattern of parallel rows of parallel bent tail portions for forming a pattern of male terminals in which the tail portions of each of the three parallel rows are of different stepped dimensions as determined by the respective aperture lengths. Printed circuit daughter-boards or flexible printed circuit cables are then soldered to the bent tail portions which are then broken off at the surface thereof to form continuous electrical contact with the printed circuitry on the so-coupled daughter-boards or flexible cable. A keyed connector guide stand-off and a connector polarizing key are provided to mate with conforming recesses in the insulative connector body for ensuring that a particular electrical connector assembly mates with a particular pattern of male contacts that project from the mother-board and that permit male contact-to-male contact back panel wiring to pass freely under the keyed connector guide stand-off.

4 Claims, 13 Drawing Figures

MOTHER-BOARD INTERCONNECTION SYSTEM

BACKGROUND OF THE INVENTION

In the prior art it is known to utilize a multi-layer printed circuit back-panel mother-board with pass-through electrical male contacts to permit double-sided packaging on the mother-board of electronic components and circuitry on printed circuit daughter-boards — see U.S. Pat. No. 3,312,878, U.S. Pat. No. 3,660,726 and the publication "Back-Panel Wiring," Part 4, The Electronic Engineer, June, 1972, Page 41. The mother-boards and daughter-boards are then packaged in a printed circuit card mounting structure — see U.S. Pat. No. 3,733,523 — using appropriate printed circuit daughter-board card guides — see U.S. Pat. No. 3,310,710 — and heat sinks — see U.S. Pat. No. 3,631,325. In such prior art packaging systems it is desirable to design the mother-board such that one electrical connector assembly may be used for all electrical connections thereto. Accordingly, it is desirable that such mother-board and the associated multiple-use electrical connector assembly be designed for maximum reliability and utility and, conversely, minimum cost. The present invention is directed toward such an electronic packaging system.

SUMMARY OF THE INVENTION

In the electronic packaging system of the present invention there is utilized a large multi-layer printed-circuit mother-board having a plurality of similar patterns of double-ended electrical male contacts. Each of the male contacts is affixed to the mother-board at an associated hole within an associated hole pattern in the mother-board, the hole patterns in the mother-board being similar to the pattern of electrical female contacts in an electrical connector assembly that mates with the pattern of male contacts. The male contacts may be electrically continuous with printed circuit wiring within the mother-board or may pass through the mother-board without any electrical connection thereto while two or more male contacts may be intercoupled by known wire-wrap methods on the back side thereof.

An electrical connector assembly is provided that mates with each of the patterns of male contacts on both the front and back sides of the mother-board; on the front side, the electrical connector assembly is integral with a printed circuit card to form a daughter-board that includes both active and passive electronic elements; on the back side, the electrical connector assembly is integral with a printed circuit flexible electrical cable for jumpering or interconnecting two or more patterns of male contacts on the mother-board or for coupling a pattern of male contacts on the mother-board to external circuitry. A keyed connector guide stand-off and connector polarizing key are provided to conform to the electrical connector assembly for ensuring that only a properly keyed electrical connector assembly will be coupled to the corresponding pattern of male contacts.

The electrical connector assembly is comprised of an insulative connector body having a mating surface and, parallel thereto, stepped, different-dimensioned, first, second and bottom edges. Three parallel rows of parallel apertures pass through the connector body from the mating surface to the first, second and third bottom edges for forming three rows of stepped, different-dimensioned-length apertures. Female contacts of substantially similar design are loosely held in each of the apertures, being inserted therein from the mating surface, with their tail portions projecting from the associated one of said first, second or third bottom edges. The tail portions are then bent 90° to form a pattern of parallel rows of parallel bent tail portions for forming a pattern of male terminals in which the tail portions of each of the three parallel rows are of different stepped dimensions as determined by the respective aperture lengths.

Printed circuit daughter-boards or flexible printed circuit electrical cables are then soldered to the bent tail portions which are then broken off at notches near the surface thereof to form continuous electrical contact with the circuitry on the daughter-boards or with the printed circuitry on the flexible electrical cables. The daughter-boards are secured in their relative positions with respect to the mother-board within a printed circuit mounting structure using appropriate printed circuit daughter-board card guides.

DESCRIPTION OF THE PREFERRED EMBODIMENTS

Figure 1:
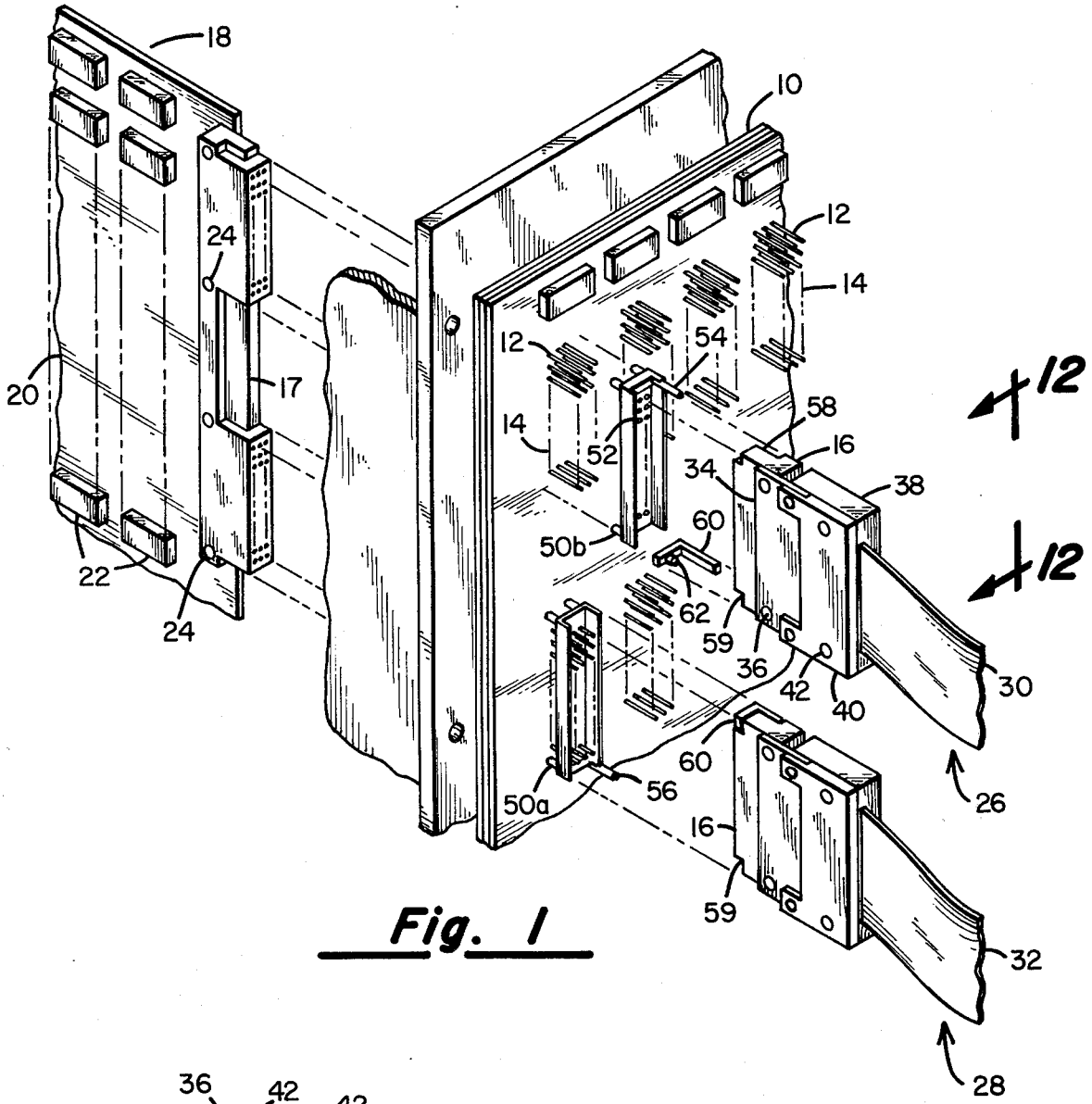
FIG. 1 is a fragmentary perspective view of the electronic packaging system of the present invention.

With particular reference to FIG. 1 there is illustrated a fragmentary perspective view of the electronic packaging system of the present invention. The packaging system includes a multi-layer printed circuit mother-board 10 having a plurality of double-ended, pass-through electrical male contacts 12 arranged in a plurality of similar patterns of male contacts that project through both the front side and the back side of mother-board 10. The similar patterns 14 of male contacts 12 conform to and mate in electrical contact with the pattern of female contacts of an electrical connector assembly 16.

Daughter-board 18, which consists of a multi-layer printed circuit board 20 and a plurality of small scale integrated (SSI) elements 22 affixed thereto, includes an electrical connector assembly 17 which is formed of two integrally molded electrical connector assemblies 16 and which is mechanically coupled to the multi-layer printed circuit board 20 by suitable attaching hardware 24 and which is electrically coupled to the printed circuit wiring thereof by means of a plurality of male terminals (not illustrated). The electrical connector assembly 17 of daughter-board 18 is illustrated as mating with the corresponding patterns 14 of male contacts 12 shown extending through the front side of mother-board 10. Additionally, daughter-board 18 is supported by appropriate printed circuit card guides and a printed circuit card mounting structure (not illustrated).

Flexible cable assemblies 26, 28 each include an electrical connector assembly 16 and the necessary associated components to provide both electrical and mechanical continuity between the flexible cables 30, 32 and the associated electrical connector assemblies 16. These necessary components, as illustrated with particular reference to flexible cable assembly 26, include a printed circuit board 34, handle 38 and plate 40. Printed circuit board 34 is mechanically coupled to electrical connector assembly 16 by means of rivets 36, and is electrically coupled, as by soldering, to the printed circuits on flexible cable 30 and the electrical contacts in electrical connector assembly 16. Handle 38 and the superposed plate 40 sandwich flexible cable 30 and printed circuit board 34 therebetween by means of rivets 42 to ensure a rigid mechanical coupling by means of printed circuit board 34 to electrical connector assembly 16 for providing a reliable coupling of electrical connector assembly 16 to the associated pattern 14 of male contacts 12 and the extraction therefrom.

Associated with flexible cable assembly 26 there is illustrated a keyed connector guide stand-off **50*b* having a pattern of apertures 52 therethrough which pattern of apertures 52 corresponds to the patterns 14 of male contacts 12 that extend from the surfaces of mother-board 10. Keyed connector guide stand-off 50*b* has a key post 54 that mates with a corresponding notch 58 in the end of electrical connector assembly 16. For polarizing keyed connector guide stand-off 50*b* with flexible cable assembly 26, electrical connector assembly 16 has a connector polarizing key 60 secured in the corresponding notch 59 of electrical assembly 16 by means of a slotted post 62 which makes a pressure fit with a corresponding aperture 93 — see FIGS. 2, 3. In contrast to this, associated with flexible cable assembly 28 is keyed connector guide stand-off 50*a* having the key post 56 that is polarized to mate with notch 59 of electrical connector assembly 16 by means of connector polarizing key 60 which by means of a slotted post 62 makes a pressure fit engagement with the corresponding aperture 92 in the corresponding notch 58 in the end of electrical connector assembly 16 — see FIGS. 2, 3, 4, 11. The use of keyed connector guide stand-off 50*a* and the associated connector polarizing key 60 ensures that only the flexible cable assembly 28 will mate with the associated pattern 14 of male contacts 12 that project from the surface of mother-board 10**.

Figure 2:
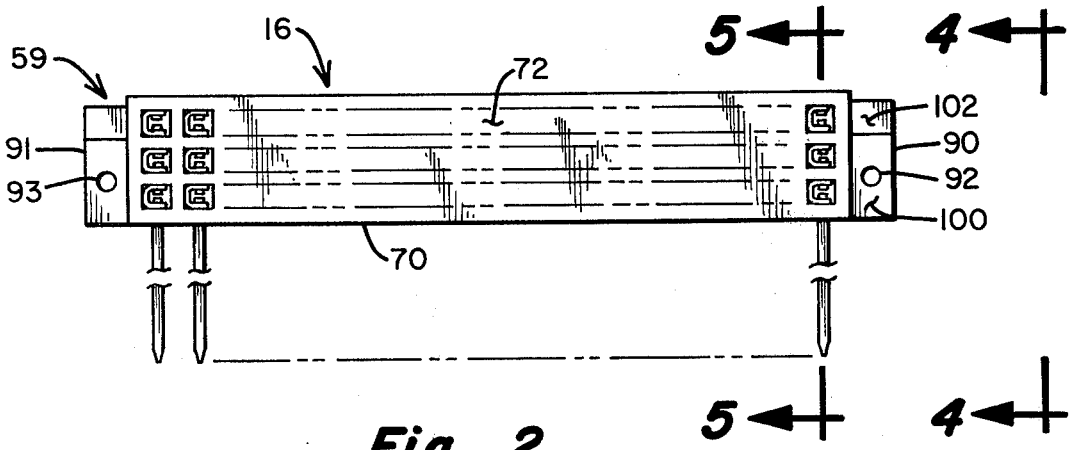
FIG. 2 is a view of the mating surface of the electrical connector assembly of the present invention.
Figure 3:
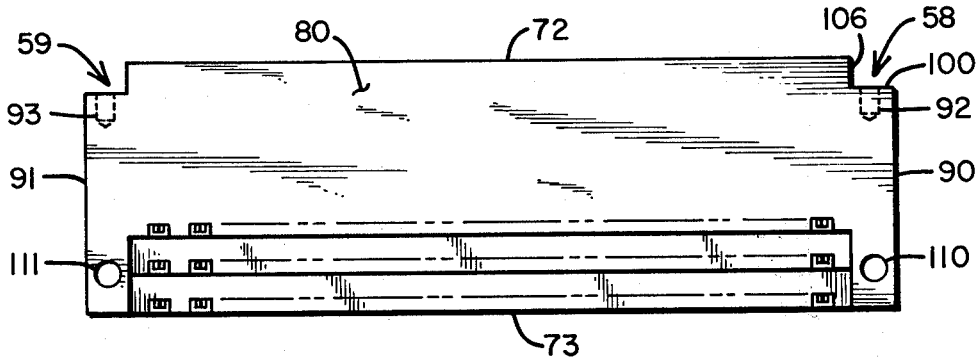
FIG. 3 is a view of the bottom surface of the electrical connector assembly of FIG. 2.
Figure 4:
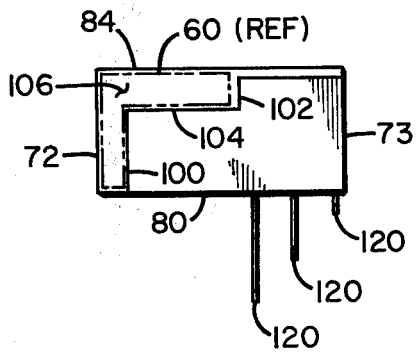
FIG. 4 is an end view of the electrical connector assembly of FIG. 2 taken along line 4—4 thereof.

With particular reference to FIGS. 2, 3 there are presented a view of the mating surface 72 and a view of the bottom surface 80, respectively, of electrical connector assembly 16 while FIG. 4 is an end view of electrical connector assembly 16 of FIG. 2 taken along line 4—4 thereof. Additionally, there is provided in FIG. 5 an enlarged sectional view of the electrical connector assembly 16 of FIG. 2 taken along line 5—5 thereof. Electrical connector assembly 16 includes an electrical connector body 70 of an insulating material, such as glass filled phenolic, Fiberite F 4004, Fiberite Corp., Winona, Minn., having a mating surface 72, first, second and third stepped bottom edges 74, 75, 76, respectively, that are substantially parallel to each other and to the mating surface 72. The stepped bottom edges 74, 75, 76 are of equally increasing first, second and third dimensions, respectively, spaced from the mating surface 72 and are parallel to the bottom surface 80 and the top surface 84 that are perpendicular to mating surface 72 and parallel to bottom edges 74, 75, 76. Additionally, electrical connector body 70 includes a plurality of parallel, substantially similar apertures 86, 87, 88 that extend perpendicularly from mating surface 72 through said electrical connector body 70 terminating at said first, second and third bottom edges 74, 75, 76, respectively, said apertures 86, 87, 88 having lengths of said first, second and third dimensions, respectively.

Figure 11:
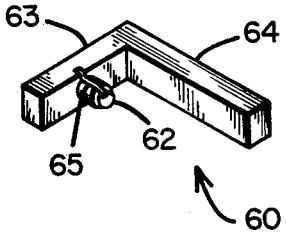
FIG. 11 is a perspective view of the connector polarizing key that is utilized with the keyed connector guide standoffs of FIGS. 10*a* and 10*b* to key certain electrical connector assemblies with their associated male contact patterns in the mother-board of FIG. 1.

Provided along the opposite ends 90, 91 of electrical connector body 70 are similarly configured right angled notches 58, 59 having the corresponding apertures 92, 93 all suitably dimensioned to mate with and to provide a nesting position for connector polarizing key 60 previously discussed with respect to FIG. 1 and as more fully detailed in FIG. 11. As illustrated in FIGS. 2, 3, 4, notch 58, and analogously notch 59, is defined by the top and bottom surfaces 100 and 102, the back surface 104 and the end surface 106. Additionally provided in electrical connector body 70 are two apertures 110 and 111 that extend through the body thereof from top surface 84 to bottom surface 80 for receiving hardware for mechanical attachment to associated components such as for receiving rivets 24 for attachment to daughter-board 18 of FIG. 1.

Figure 6:
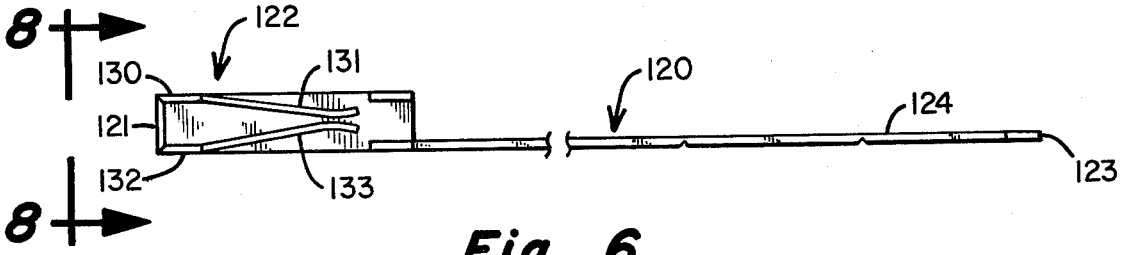
FIG. 6 is a top view of the female contact incorporated in the electrical connector assembly of FIG. 2.
Figure 7:
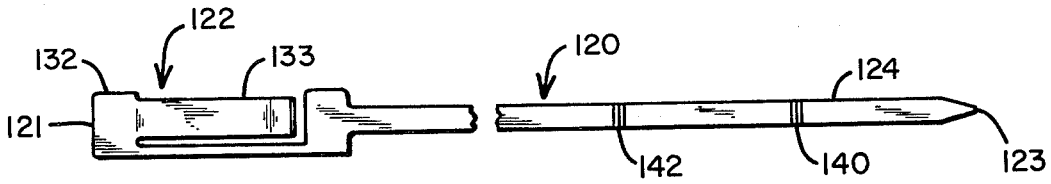
FIG. 7 is a side view of the female contact of FIG. 6.

With particular reference to FIGs. 6, 7 there are presented illustrations of the top view and the side view of the electrical female contacts 120, a plurality, e.g., 60, of which are assembled within electrical connector assembly 16 as illustrated in FIGS. 2, 3, 4 and 5. Electrical contact 120 is formed of an electrically conducting sheet metal stock, such as beryllium copper per ASTM-B-194 or phosphor bronze per ASTM B 103, alloy A, having a long axial dimension. A first end 121 of female contact 120 is formed into a first axially aligned open-faced three-sided female receptacle 122 for receiving an axially aligned male contact 12 — see FIG. 1 — and a second end 123 that is formed into a second axially aligned tail portion 124, the axial cross-section of electrical contact 120 being adapted for a loosely unrestrained fit within the similarly cross-sectioned apertures 86, 87, 88 of electrical connector body 70. Female contacts 120 are preferably formed in a continuous series of steps such as exemplified by the V. G. Hatfield, et al., U.S. Pat. No. 3,288,915.

Figure 8:
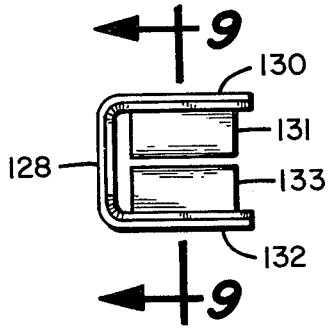
FIG. 8 is an end view of the female receptacle end of the female contact of FIG. 6 taken along line 8—8 thereof.
Figure 9:
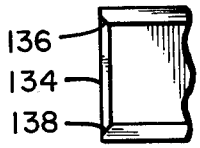
FIG. 9 is a detail view of the coined internal entry edges of the female receptacle end of the female contact of FIG. 6 taken along line 9—9 thereof.

With particular reference to FIG. 8 there is presented an illustration of an end view of the female receptacle 122 of female contact 120 of FIG. 6 taken along line 8—8 thereof. Additionally, there is in FIG. 9 presented a detail illustration of the coined internal entry edges of the female receptacle 122 of FIG. 8 taken along line 9—9 thereof. Female receptacle 122 includes a sidewall 128 and top and bottom walls 130 and 132, respectively, that form the axially aligned open-faced three-sided female receptacle 122, the rearward extensions 131 and 133 of top and bottom walls 130 and 132, respectively, are compressed inwardly for providing a compressive mechanical gripping action upon the to-be-inserted male contact 12. Also illustrated are the coined internal entry edges 134, 136, 138 of the associated sidewall 128, top wall 130 and bottom wall 132, respectively. The coined internal entry edges 134, 136, 138 of female receptacle 122 aid in the entry alignment of male contact 12 into female contact 120.

Figure 5:
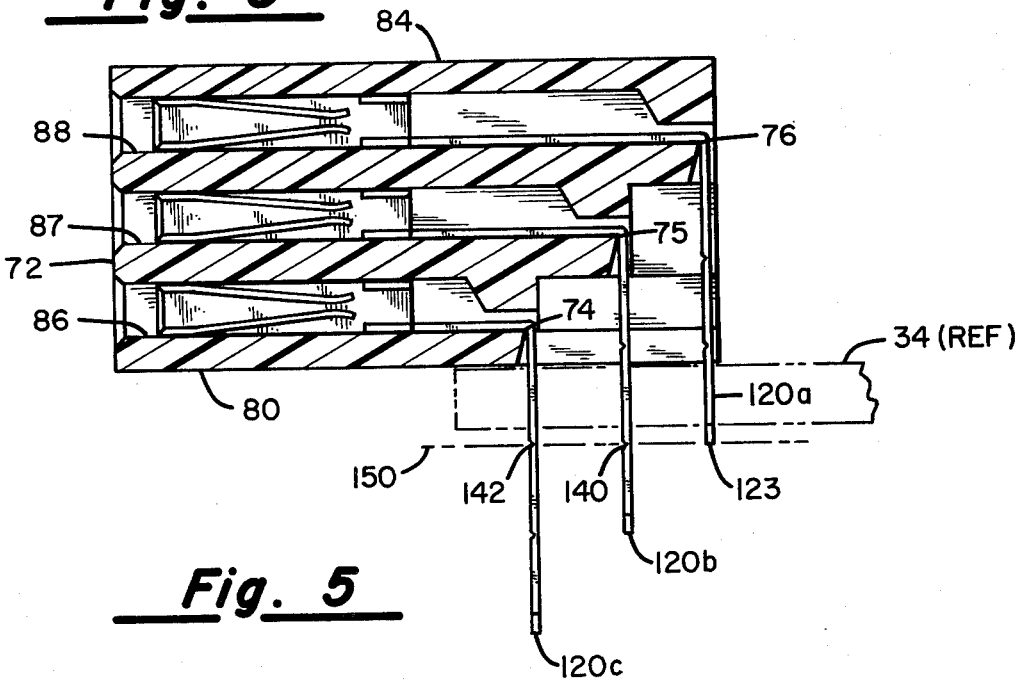
FIG. 5 is an enlarged sectional view of the electrical connector assembly of FIG. 2 taken along line 5—5 thereof.

Female contact 120 has, in its tail portion 124, at least two spaced-apart notches 140, 142 that are dimensioned from the second end 123 such that when female contacts 120 are inserted in their associated apertures 86, 87, 88 and bent 90° over their associated edges 74, 75, 76, respectively, to be perpendicular to the bottom surface 80, the associated tail portions 124 extend beyond such bottom surface 80 different stepped lengths for establishing one of the two notches 142, 140 of the bent tail portions 124 that project from the first and second bottom edges 74, 75, respectively, at the same distance from such bottom surface 80 as determined by the second end 123 of the bent tail portion 124 of the female contact 120 that is inserted into aperture 88 and that projects from bottom edge 76. This configuration, as illustrated in FIG. 5, indicates that the second end 123 of female contact 120*a*, the notch 140 of female contact 120*b* and the notch 142 of female contact 120*c* all are aligned along an imaginary plane 150 that is parallel to bottom surface 80. This feature permits the three parallel rows of parallel bent tail portions 124 of female contacts 120 to be inserted into a mating pattern of apertures in an associated printed circuit member, such as printed circuit members 20 and 34 of FIG. 1, to be electrically affixed thereto as by soldering and then to have the tail portions 124 broken off, as at plane 150, to provide a substantially uniform projection from the associated printed circuit member.

Figure 10A:
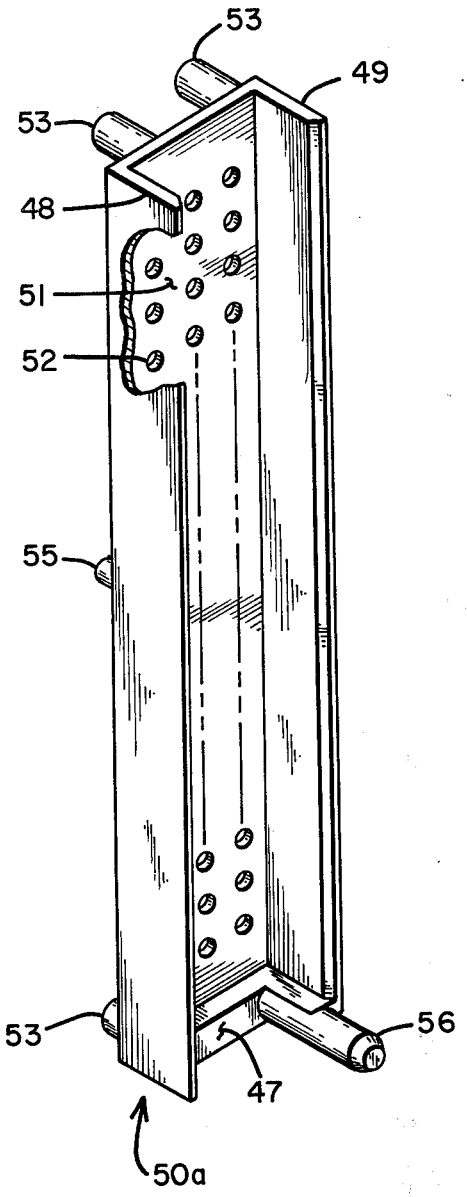
FIGS. 10*a* and 10*b* are perspective views of the keyed connector guide stand-offs utilized by the electrical connector assembly of FIG. 2.
Figure 10B:
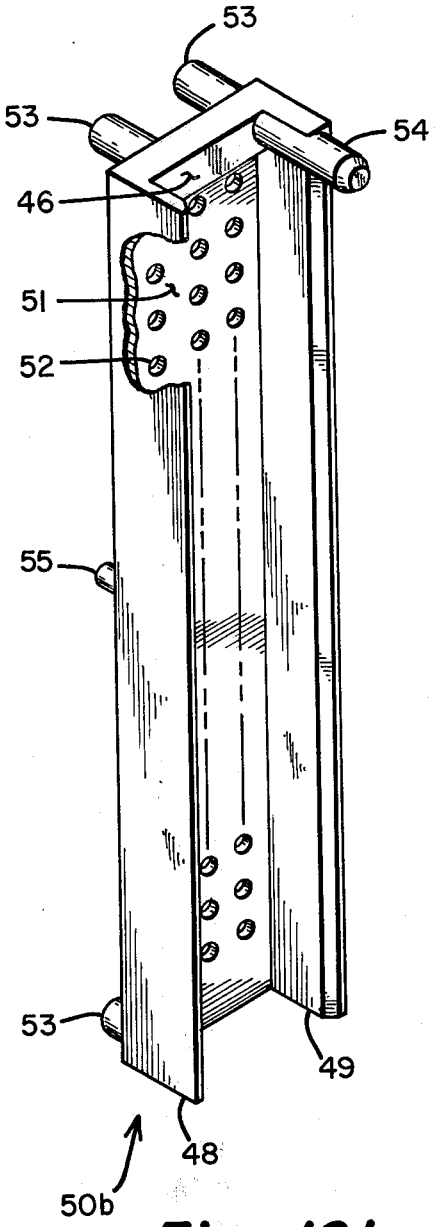

With particular reference to FIGS. 10*a* and 10*b* there are presented perspective views of the keyed connector guide stand-offs 50*a* and 50*b*, respectively, utilized by electrical connector assembly 16 of FIG. 2. In FIG. 11 there is presented a perspective view of the connector polarizing key 60 that is utilized with keyed connector guide stand-offs 50*a* and 50*b* to key certain electrical connector assemblies 16 only with certain associated male contact patterns 14 as illustrated in FIG. 1. Keyed connector guide stand-offs 50*a* and 50*b* are made of a relatively pliable plastic insulating material, such as 6/6 unfilled Nylon, Zytel 101, E. I. DuPont, Inc., having two side walls 48 and 49 along the long edges of a rectangular base member 51 in which a plurality of apertures 52 pass therethrough, all in a pattern that conforms to the patterns 14 of male contacts 12 of FIG. 1. Extending downwardly from base member 51 at the four corners threof are the four similar legs 53 and intermediate the two ends thereof are the two similar legs 55 along the opposite long edges. Along the opposite short edges or ends and projecting upwardly thereof are two key posts 54 and 56 associated with keyed connector guide 50*b* and 50*a*, respectively, which key posts 54 and 56 include the associated connector stop members 46 and 47. Except for the placement of the key posts 54 and 56, keyed connector guide stand-offs 50*a* and 50*b* are of substantially similar design.

The keyed connector guide stand-offs of FIGS. 10*a* and 10*b* are utilized in the present invention in two different embodiments: a first embodiment 50*a* in which key post 56 is utilized to nest in notch 59 while connector polarizing key 60 is assembled in notch 58 of electrical connector assembly 16, and a second embodiment 50*b* in which key post 54 is utilized to nest in notch 58 while connector polarizing key 60 is assembled in notch 59 of electrical connector assembly 16. The presence of the key post 56 or 54 in the associated keyed connector guide stand-off 50*a* or 50*b*, respectively, is utilized along with connector polarizing key 60 of FIG. 11, which is assembled upon electrical connector 16 at either end thereof in the associated notch 58, 59 by means of a split post 62, to key an electrical connector assembly 16 and the associated flexible cable assembly to only the associated keyed connector guide stand-off as assembled upon one of the patterns 14 of male contacts 12 as illustrated in FIG. 1 — with particular reference to flexible cable assembly 26 and 28.

In FIG. 11, connector polarizing key 60 is shown to be composed of two, substantially straight right angled legs 63, 64 having a generally cylindrical-like post 62 projecting from the inside surface of leg 63 with a slot 65 oriented radially and vertically along the length thereof. The outside diameter of post 62 in combination with the slot 65 cooperate to provide within apertures 92, 93 of connector body 70 — see FIG. 2 — a pressure fit therein for securely attaching connector polarizing key 60 to either notch 58 or 59 at the opposite ends of electrical connector assembly 16. Connector polarizing key 60 is preferably formed of the same material as is keyed connector guid stand-off 50.

To further key an associated electrical connector assembly 16 with the associated pattern 14 of male contacts 12 on mother-board 10, in the preferred embodiment of applicant's invention, keyed connector guide stand-off 50*a* was formed of a green colored plastic material while keyed connector guide stand-off 50*b* was formed of a red plastic material while connector polarizing key 60 was formed of both red and green materials. The red colored connector polarizing key 60 was assembled on the left hand edge 91 of electrical connector assembly 16 by means of aperture 93 to mate with keyed connector guide stand-off 50*b* while green colored connector polarizing key 60 was assembled on the right hand edge 90 of electrical connector assembly 16 by means of aperture 92 to mate with keyed connector guide stand-off 50*a*.

Figure 12:
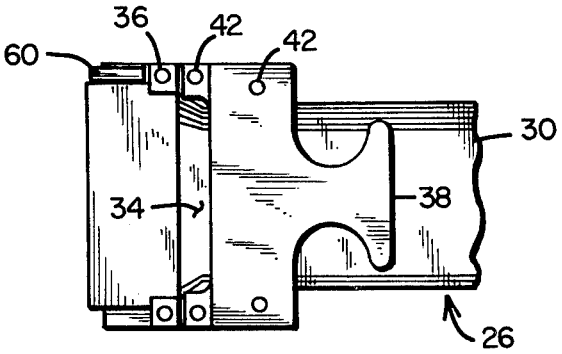
FIG. 12 is a side view, taken along line 12—12 of FIG. 1, illustrating how the electrical connector assembly of FIG. 2 and a flexible printed circuit are assembled.

With particular reference to FIG. 12 there is presented a side view taken along line 12—12 of FIG. 1 illustrating how the electrical connector assembly 16 and the flexible cable 30 are assembled to form electrical cable assembly 26. This view illustrates how the rivets 36, 42 are utilized to ensure a rigid, mechanical assembly of handle 38, plate 40, printed circuit member 34 and electrical connector assembly 16.

Referring back to FIG. 5 there is illustrated in phantom lines, printed circuit board 34 of flexible cable assembly 26 wherein it is illustrated that the terminal or tail portions 124 of electrical contacts 120*b* and 120*c* are broken off at their respective notches 140 and 142, respectively, and project slightly beyond the surface of printed circuit board 34 for providing a reliable, soldered electrical connection to the plated-through holes or the printed circuitry in printed circuit board 34. Additionally, referring back to FIG. 4 there is illustrated in phantom lines the manner in which connector polarizing key 60 is positioned in notch 58 on the appropriate end 90 of electrical connector assembly 16 upon the surfaces 100, 104 and is assembled therewith by split post 62 having a pressure fit within the corresponding aperture 92 in connector body 70.

The electronic packaging system of the present invention and in particular the design of electrical connector assembly 16 and the associated female contacts 120, provides a versatile, reliable method of coupling electronic circuitry to a mother-board. In particular, with each of the female contacts 120 installed in the corresponding apertures 86, 87, 88 of connector body 70 in a loosely unrestrained manner, tolerance build-up between the pattern 14 of male contacts 12 in mother-board 10 and the corresponding pattern of the female contacts 120 in electrical connector assembly 16 permit slight movement between the mating female contact 120 assembled within connector body 70 and the one associated male contact 12 within the pattern 14 that projects from the surface of mother-board 10. This loosely unrestrained assembly of female contacts 120 within the connector body 70 along with the coined internal entry edges of the axially aligned open-faced three-sided female receptacle 122 — see FIGS. 6, 7, 8, 9 — ensure that maximum electrical continuity is provided between electrical connector assembly 16 and the associated pattern 14 of male contacts 12 in mother-board 10 while permitting minimum force to be required for insertion and extraction of the corresponding mating parts thereof. Further, by relying upon only the bent tail portion 124 of the female contact 120 to secure the female contact 120 within the associated apertures 86, 87, 88 in connector body 70, rapid maintenance and repair of electrical connector assembly 16 is ensured.

What is claimed is:

1. In a mother-board interconnection system in which a keyed electrical connector assembly having a polarizing key assembled in a first one of two polarizing key notches formed in its two opposite short ends is electrically coupled to a pattern of electrical contacts projecting from said mother-board, an insulative keyed connector guide stand-off that generally conforms to, receives and positions said keyed electrical connector assembly a predetermined distance away from said mother-board permitting electrical wiring to pass therebetween, said insulative keyed connector guide stand-off comprising:

a rectangular base member having two opposite long edges and two opposite short edges and a plurality of apertures therethrough, which apertures are arranged in a pattern that conforms to and mates with said pattern of electrical contacts in said mother-board;

two side walls projecting upwardly from said base member and oriented along said two opposite long edges;

a key post projecting upwardly from said base member and oriented along only a second one of said two opposite short edges, said key post generally conforming to a polarizing key notch in said keyed electrical connector assembly, said two side walls and said key post combining to form an open end along the first one of said two opposite short ends and to accept and mate with only said keyed electrical connector assembly;

a pluraity of legs projecting downwardly from said base member for positioning said keyed electrical connected assembly a predetermined distance away from said mother-board and permitting electrical wiring to pass therebetween.

2. In a mother-board interconnection system in which a keyed electrical connector assembly having a polarizing key assembled in a first one of two polarizing key notches formed in its two opposite short ends is electrically coupled to a pattern of electrical contacts projecting from said mother-board, an insulative keyed connector guide stand-off that generally conforms to, receives and positions said keyed electrical connector assembly a predetermind distance away from said mother-board permitting electrical wiring to pass therebetween, said insulative keyed connector guide stand-off comprising:

a rectangular, planar base member having two opposite long edges and two opposite short edges and a plurality of apertures therethrough which apertures are arranged in a pattern of apertures that conforms to and mates with said pattern of electrical contacts in said mother-board;

two parallel, planar side walls perpendicularly projecting upwardly from said base member, each oriented along an associated one of said two opposite long edges;

a key post, including a connector stop member, perpendicularly projecting upwardly from said base member and oriented along only a second one of said two opposite short edges and generally conforming to a polarizing key notch in a keyed electrical connector assembly, said two side walls and said key post combining to form an open end along the first one of said two opposite short edges and to accept and mate with only said keyed electrical connector assembly;

a plurality of separate legs projecting perpendicularly downwardly from said base member to position said keyed electrical connector assembly a predetermined distance away from said mother-board for permitting electrical wiring to pass between said stand-off and said mother-board.

3. For use in combination with a multi-layer mother-board having a plurality of double-ended male pass-through electrical contacts arranged in a plurality of similar patterns of male contacts, the combination comprising:

an insulative connector polarizing key comprised of two substantially straight legs oriented at a right angle to each other, one of said legs having a cylindrical post projecting perpendicularly from the inside surface thereof parallel to the other one of said legs and a slot in said post oriented radially along the length thereof;

an electrical connector assembly including an insulative connector body having a plurality of female contacts arranged in a pattern of female contacts on a mating surface thereof, which pattern of female contacts conforms to and mates with the patterns of male contacts that are arranged on aid mother-board, first and second like oriented similar connector polarizing key notches formed in opposite ends of said connector body, each of said connector polarizing key notches including at least one aperture, each of said first and second connector polarizing key notches adapted to conform to and receive said connector polarizing key, said connector polarizing key assembled therewith, the aperture of said connector polarizing key notch adapted for a press fit with the slotted post of said assembled with connector polarizing key;

an insulative keyed connector guide stand-off assembled with said electrical connector assembly and comprised of a rectangular base member having a plurality of apertures therethrough which apertures are arranged in a pattern of apertures that conforms to and mates with the male pass-through electrical contacts of said pattern of male contacts, a plurality of equal length legs projecting downwardy from said base member for positioning said assembled with electrical connector assembly a predetermined distance away from said mother-board, two side walls projecting upwardly from said base member and oriented along the two opposite long edges of said base member and a key post projecting upwardly from said base member and oriented along one of the two opposite short ends of said base member, said two side walls and said key post combining to form an open end along the second one of said two opposite short ends, said key post generally conforming to the pattern of the two legs of said connector polarizing key for conforming to and being received by the one of said connector polarizing key notches that is not occupied by said assembled with connector polarizing key.

4. For use in combination with a mother-board having a plurality of male electrical contacts projecting from one surface thereof and arranged in a plurality of similar patterns of male contacts, the combination comprising:

an electrical connector assembly including an insulative connector body having a plurality of female contacts arranged in a pattern of female contacts on a mating surface thereof, which pattern of female contacts conforms to and mates with the patterns of male contacts that are arranged on said mother-board, first and second similar connector polarizing key notches formed in opposite ends of said connector body, each of said connector polarizing key notches including at least one aperture;

a connector polarizing key having a cylindrical post projecting therefrom and a slot in said post oriented radially along the length thereof and adapted for a press fit within the apertures of said two connector polarizing key notches, said connector polarizing key assembled with and nesting in one of said two connector polarizing key notches for conforming to the outside surfaces of said connector body;

an insulative keyed connector guie stand-off assembled with said electrical connector assembly and comprised of a substantially rectangular, planar, base member having a plurality of apertures therethrough which apertures are arranged in a pattern of apertures that conforms to and mates with the male electrical contacts of the patterns of male contacts that are arranged on said mother-board, a plurality of legs projecting downwardly from said base member for positioning the bottom surface of said base member a predetermined distance away from said mother-board, two side walls projecting upwardly from said base member and oriented along the two opposite long edges of said base member and a key post projecting upwardly from said base member and oriented along one of the two opposite short ends of said base member, said two side walls and said key post combining to form an open end along the second one of said two opposite short ends, said key post generally conforming to the pattern of said connector polarizing key for conforming to and being received by the corresponding one of said key notches in said assembled with electrical connector assembly in which said connector polarizing key is not nesting.

* * * * *